US006102677A

United States Patent [19]

Iida et al.

[11] Patent Number: 6,102,677

[45] Date of Patent: Aug. 15, 2000

[54] HERMETIC COMPRESSOR

[75] Inventors: Noboru Iida; Kiyoshi Sawai, both of Shiga, Japan

[73] Assignee: Matsushita Electric Industrial Co., Ltd., Osaka, Japan

[21] Appl. No.: 09/174,419

[22] Filed: Oct. 19, 1998

[30] Foreign Application Priority Data

Oct. 21, 1997 [JP] Japan ..... 9-306583
Oct. 21, 1997 [JP] Japan ..... 9-306584

[51] Int. Cl.[7] ..... F04B 19/02

[52] U.S. Cl. ..... 417/463; 417/410.3; 417/410.4; 417/902

[58] Field of Search ..... 417/463, 410.3, 417/410.4, 902; 418/61.3, 164

[56] References Cited

U.S. PATENT DOCUMENTS

| | | | |
|---|---|---|---|
| 4,648,811 | 3/1987 | Tahata et al. | 417/410.3 |
| 5,358,386 | 10/1994 | Koyama et al. | 417/312 |
| 5,419,692 | 5/1995 | Irino | 418/83 |
| 5,531,574 | 7/1996 | Honma | 417/415 |

*Primary Examiner*—Teresa Walberg
*Assistant Examiner*—Vinod D Patel
*Attorney, Agent, or Firm*—Armstrong, Westerman, Hattori, McLeland & Naughton

[57] ABSTRACT

A hermetic compressor according to the present invention uses a compressing mechanism which includes a rotary cylinder having a groove, and a piston slidable in the groove, so that the piston is rotated on a locus of a radius E about a position spaced apart at a distance E from the center of the rotary cylinder, thereby performing a compression stroke. In this compressing mechanism, the rotary cylinder is rotated and slid within the groove by rotation of the piston on the locus of the radius E about the position spaced apart at the distance E from the center of the rotary cylinder. Therefore, two spaces are defined in the groove by the piston and varied in volume by the sliding movement of the piston, whereby the compression and suction can be carried out.

In this way, the compressing mechanism performs the compression and suction by only the rotating motions of the rotary cylinder and the piston, and does not require a member which is moved in a diametrical direction, such as vanes required in a rotary compressor, Oldham ring required in a scroll compressor and the like. Therefore, it is possible to realize a hermetic compressor, in which even if the compressing mechanism is fixed within a shell, only an extremely small vibration occurs.

10 Claims, 6 Drawing Sheets

PRIOR ART

HERMETIC COMPRESSOR

TECHNICAL FIELD

The present invention relates to a hermetic compressor used in a refrigeration cycle system.

BACKGROUND ART

There is a conventionally proposed principle of a compressing mechanism which includes a rotary cylinder having a groove, and a piston slidable within the groove, so that the rotary cylinder is rotated in accordance with the movement of the piston to perform suction and compression strokes (for example, see German Patent No.863,751 and British Patent No.430,830).

The conventionally proposed principle of the compressing mechanism will be described below with reference to FIG. 8.

The compressing mechanism is comprised of a rotary cylinder 101 having a groove 100, and a piston 102 which is slidable within the groove 100. The rotary cylinder 101 is provided for rotation about a point A, and the piston 102 is rotated about a point B.

The movements of the piston and the cylinder will be described as for a case where the rotational radius of the piston 102 is equal to the distance between the rotational center A of the rotary cylinder 101 and the orbital center B of the piston 102.

When the rotational radius of the piston 102 is larger or smaller than the distance between the rotational center A of the rotary cylinder 101 and the orbital center B of the piston 102, different movements are performed. The description of these different movements is omitted herein.

A broken line C in FIG. 8 indicate a locus for the piston 102.

FIGS. 8*a* to 8*i* show states in which the piston 102 has been rotated through every 90 degree.

First, the movement of the piston 102 will be described below. FIG. 8*a* shows the state in which the piston lies immediately above the orbital center B. FIG. 8*b* shows the state in which the piston 102 has been rotated through 90 degree in a counterclockwise direction from the state shown in FIG. 8*a*. FIG. 8*c* shows the state in which the piston 102 has been rotated through 180 degree in the counterclockwise direction from the state shown in FIG. 8*a*. FIG. 8*d* shows the state in which the piston 102 has been further rotated through 270 degree in the counterclockwise direction from the state shown in FIG. 8*a*. FIG. 8*e* shows the state in which the piston 102 has been rotated through 360 degree in the counterclockwise direction from the state shown in FIG. 8*a* and has been returned to the state shown in FIG. 8*a*.

The movement of the rotary cylinder 101 will be described below. In the state shown in FIG. 8*a*, the rotary cylinder 101 is located, so that the groove 100 is located vertically. When the piston 102 is moved through 90 degree in the counterclockwise direction from this state, the rotary cylinder 101 is rotated through 45 degree in the counterclockwise direction, as shown in FIG. 8*b* and hence, the groove is likewise brought into a state in which it is inclined at 45 degree. When the piston 102 is rotated through 180 degree in the counterclockwise direction from the state shown in FIG. 8*a*, the rotary cylinder 101 is rotated through 90 degree in the counterclockwise direction, as shown in FIG. 8*c* and hence, the groove 100 is likewise brought into a state in which it is inclined at 90 degree.

In this way, the rotary cylinder 101 is rotated in one direction with the rotation of the piston 102, but while the piston 102 is rotated through 360 degree, the rotary cylinder 101 is rotated through 180 degree.

The change in volume of the groove 100 defining the compressing space will be described below.

In the state shown in FIG. 8*a*, the piston 102 lies at one end in the groove 100 and hence, only one space 100 exists. This space 100 is called a first space 100*a* herein. In the state shown in FIG. 8*b*, the first space 100*a* is narrower, but a second space 100*b* is produced on the opposite side of the piston 102. In the state shown in FIG. 8*c*, the first space 100*a* is as small as half of the space in the state shown in FIG. 8*a*, but a second space 100*b* of the same size as the first space 100*a* is defined. This first space 100*a* is zero in volume in the state shown in FIG. 8*e* in which the piston 102 has been rotated through 360 degree.

In this way, the two spaces 100*a* and 100*b* are defined by the piston 102 and repeatedly varied in volume from the minimum to the maximum and from the maximum to the minimum, whenever the piston 102 is rotated through 360 degree.

Therefore, the spaces defining the compressing chambers perform the compression and suction strokes by the rotation of the piston 102 through 720 degree.

The above-described compressing principle suffers from the following problem: When the piston 102 is at the center A of rotation of the rotary cylinder 101, the direction of a force provided by the rotational force of the piston 102 is the same as the direction of the groove 100 and hence, this force does not rotate the rotary cylinder 101. Therefore, when the piston 102 is at the center A of rotation of the rotary cylinder 101, the above-described movement is actually continuously not performed, if the rotational force is not applied to the rotary cylinder 101.

Various methods for providing the rotational force to the rotary cylinder 101 against the above problem are considered currently, and it is an object of the present invention to provide an optimal approach in a hermetic compressor used in a refrigerating cycle system.

A continuous movement is realized by using two compressing mechanisms synchronized with each other with different phases. More specifically, by two compressing mechanisms synchronized with each other with different phases, the rotational force of one of the rotary cylinders can be applied to the other rotary cylinder. Therefore, even if either one of the rotary cylinders is brought into a state in which it does not receive the rotational force from the piston, the other rotary cylinder applies the rotational force to the one rotary cylinder and hence, the rotation can be continuously maintained. However, when the two compressing mechanisms synchronized with each other with different phases are used, two compressing chambers must be independent, because the compression strokes in the two compressing chambers are different from each other. Therefore, a partition plate is required between the rotary cylinders defining the two compressing chambers. On the other hand, a shaft for driving the piston in each of the compressing chambers is also required. Thereupon, a through-bore for passage of the shaft is required in the partition plate.

In this case, it is not preferable that the shaft is constructed with a dividing member connected thereto from a strength consideration and a accuracy consideration. Thus, a large compressing force is applied to the shaft for driving the piston, but a large torsional stress is applied to the shaft. With the above-described compressing mechanisms, not only the positioning relationship between the piston and the rotary cylinders but also the positioning relationship between the two rotary cylinders must be regulated with a good accuracy in an assembling step. Therefore, for example, if a construction is employed in which the shaft and the dividing member are fitted with each other in a screwing manner, it is difficult to ensure the accuracy.

From the above reason, the shaft is formed from a single member. However, if the shaft is formed from a single member, the shaft must be inserted from one side of the partition plate.

Accordingly, it is an object of the present invention to provide a construction of two compressing mechanisms interconnected in a synchronized manner and capable of being industrially produced, which construction is employed in a hermetic compressor.

It is another object of the present invention to provide a hermetic compressor having a higher compression efficiency by preventing the communication between compressing spaces having different phases.

SUMMARY OF THE INVENTION

A close-type compressor according to the present invention comprises compressing mechanisms each of which includes a rotary cylinder having a groove, and a piston slidable in the groove, so that a compressing stroke is carried out by rotation of the piston on a locus of a radius E about a location spaced apart at a distance E from the center of the rotary cylinder. In the compressing mechanism, the piston is rotated on the locus of the radius E about the location spaced apart at the distance E from the center of the rotary cylinder, thereby causing the rotary cylinder to be rotated and slide within the groove. Therefore, two spaces are defined within the groove by the piston and varied in volume by the sliding movement of the piston, whereby the compression and suction can be performed.

In this way, the compressing mechanism carries out the compression and suction by only the rotating motions of the rotary cylinder and the piston, and does not require a member which is moved in a diametrical direction, such as vanes required in a rotary compressor, Oldham ring required in a scroll compressor and the like. Therefore, it is possible to realize a hermetic compressor, in which even if the compressing mechanisms are fixed within a shell, only an extremely small vibration occurs. /

A hermetic compressor according to claim 1 of the present invention comprises a plurality of compressing mechanisms, in which all rotary cylinders are connected together, and all pistons are driven by a common shaft. And the phase in the compression stroke in at least one of the compressing mechanisms is different from those in the other compressing mechanisms. By the fact that the plurality of compressing mechanisms are provided and connected together, and the phase in the compression stroke in at least one of the compressing mechanisms is different from those in the other compressing mechanisms, as described above, even if the piston is at the center of the rotary cylinder in one of the compressing mechanisms, the other compressing mechanism has a rotational force. Therefore, it is possible to avoid the case where the driving force from the piston does not act as a rotational force for the rotary cylinder. /

A hermetic compressor according to claim 2 of the present invention comprises two compressing mechanisms of the above-described type, in which rotary cylinders are connected together, and pistons are driven by a common shaft. The phases in the compression strokes in the first and second compressing mechanisms are different from each other. By the fact that the two compressing mechanisms are provided and connected together, and the phases in the compression strokes in the first and second compressing mechanisms are different from each other, as described above, even if the piston is at the center of the rotary cylinder in one of the compressing mechanisms, the other compressing mechanism has a rotational force. Therefore, it is possible to avoid the case where the driving force from the piston does not act as a rotational force for the rotary cylinder. /

According to claim 3 of the present invention, in addition /to the feature of claim 1 or 2, a phase difference is 180 degree. By provision of the phase difference of 180 degree, the pistons can be disposed symmetrically with each other and hence, can be easily produced. /

According to claim 4 of the present invention, in addition /to the feature of any of claims 1 to 3, the compressing mechanisms are disposed within a lower portion of a shell, and a lubricating oil is accumulated within the lower portion of the shell. Even if the compressing mechanisms are disposed in the lower portion of the shell in which the lubricating oil is accumulated, as described above, the lubricating oil cannot be agitated, because the compressing mechanism has no movable portion. Therefore, the amount of the lubricating oil enclosed in the shell can be reduced. By reducing the amount of the enclosed lubricating oil, the amount of a refrigerant dissolved into the lubricating oil can be also reduced, and the amount of the refrigerant enclosed in a refrigerating system can be also reduced. /

According to claim 5 of the present invention, in addition /to the feature of claim 2, the first and second compressing mechanisms are provided between an upper and lower bearings; intake and discharge ports for the first compressing mechanism are provided in the upper bearing; and intake and discharge ports for the second compressing mechanism are provided in the lower bearing. By provision of the intake and discharge ports in the upper and lower bearings as described above, the freedom degree of setting of the positions of the intake and discharge ports is increased. Therefore, it is possible to regulate the compression ratio and to prevent the over-compression by virtue of the positions of the intake and discharge ports. /

According to claim 6 of the present invention, in addition /to the feature of claim 5, the phases of the first and second compressing mechanisms are different by 180 degree from each other, and the intake port in the upper bearing and the intake port in the lower bearing are provided on the same axis. With such arrangement, intake pipes can be mounted on the same side, and a piping cannot be drawn around for connection the intake pipes to the accumulator or the like. /

According to claim 7 of the present invention, in addition /to the feature of claim 5, each of the intake ports is provided at a location in which it is not in communication with the two spaces defined in the groove by the piston, when the two spaces are in a relationship of maximum and minimum to each other. By provision of the intake ports at such locations, it is possible to prevent the compressed gas from being withdrawn out of the compressing spaces at the start and end of the compression stroke, thereby enhancing the compressing efficiency. /

According to claim 8 of the present invention, in addition /to claim 5, each of the discharge ports is provided at a location in which it is not in communication with the two spaces defined in the groove by the piston, when the two spaces are in a relationship of maximum and minimum to each other. By provision of the discharge ports at such locations, it is possible to prevent the discharged compressed gas from being returned into the compressing spaces at the start and end of the compression stroke, thereby enhancing the compressing efficiency. /

According to claim 9 and 10 of the present invention, in /addition to the feature of claim 5, a hermetic compressor comprises two compressing mechanisms, in which rotary cylinders are connected together; pistons are driven by a common shaft, and the compression strokes and phases of the first and second compressing mechanisms are different from each other. By the fact that the two compressing mechanisms are provided and connected together, and the compression strokes and phases of the first and second compressing mechanisms are different from each other, as described above, even if the piston is at the center of the rotary cylinder in one of the compressing mechanisms, the other compressing mechanism has a rotational force. Therefore, it is possible to avoid the case where the driving force from the piston does not act as a rotational force for the rotary cylinder.

In the hermetic compressor-according to claim 9 of the present invention, the following expressions are established:

$$Dh \geqq Dc$$

$$Dh \geqq Ds+2E$$

wherein Dh represents a diameter of a communication bore; Ds represents a diameter of a shaft; and Dc represents a diameter of a crank section. By setting the diameter of the communication bore in a range represented by the above expressions, the shaft can be inserted from one side of a partition plate to form the two compressing mechanisms.

According to claim 10 of the present invention, in addition to claim 9, the following expression is established:

$$Dh \leqq Dp-4E$$

wherein Dp represents a diameter of the piston. By setting the diameter Dh of the communication bore in a range represented by the above expression, the communication bore is in a state in which it is always occluded by the piston. Therefore, even if the compression strokes in the two compressing spaces are different from each other, it is possible to prevent the compressed gas in one of the compressing spaces from being leaked into the other compressing space.

BRIEF DESCRIPTION OF THE DRAWINGS

FIGS. 7*a* to 8*h* are illustrations for explaining the movement in a compressing mechanism in the embodiment; and FIGS. 8*a* to 8*i* are illustrations for explaining the principle of the compressor.

BEST MODE FOR CARRYING OUT THE PRESENT INVENTION

The present invention will now be described by way of an embodiment with reference to the accompanying drawings.

Figure 1:
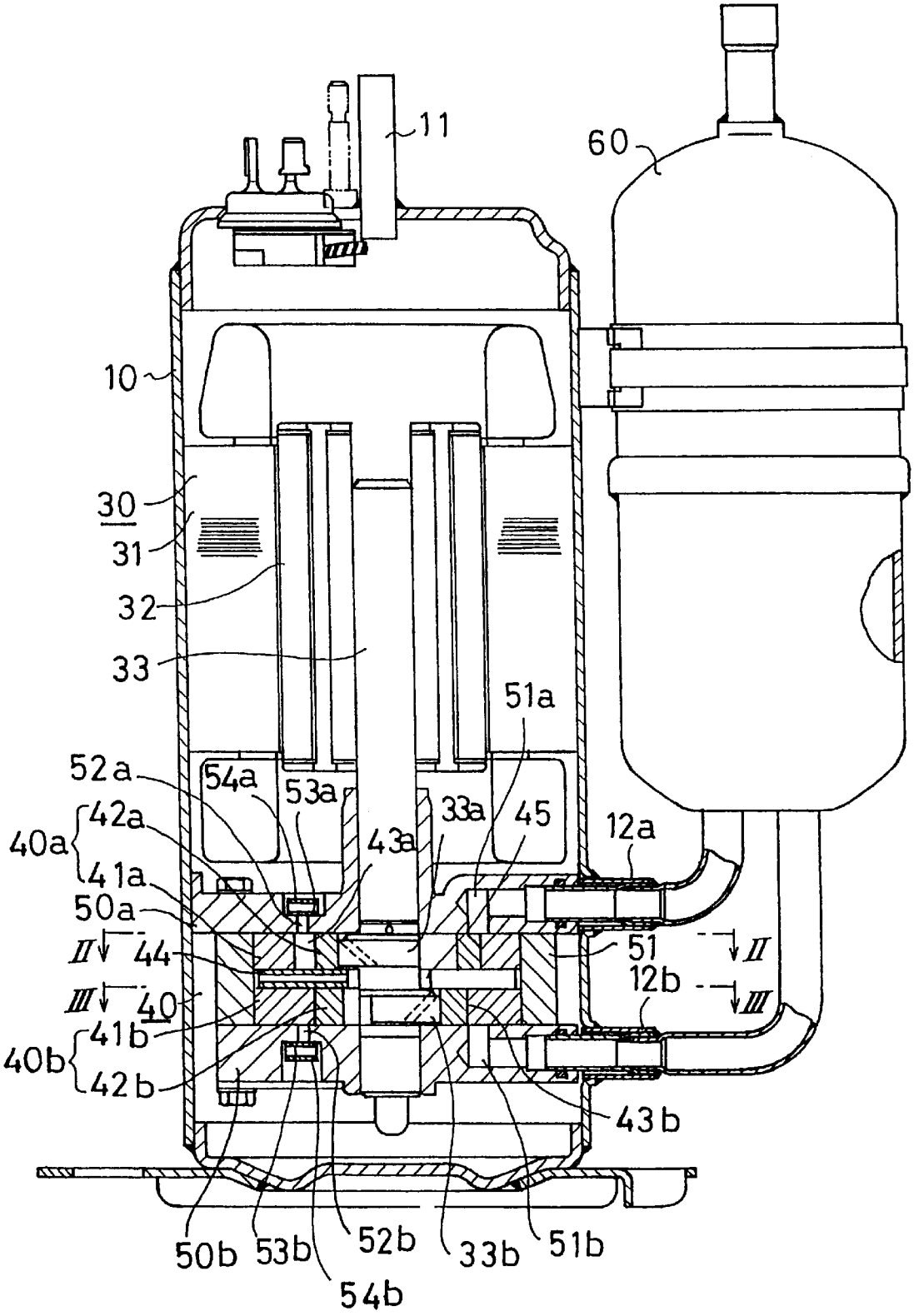
FIG. 1 is a vertical sectional view of a hermetic compressor according to an embodiment of the present invention.
Figure 2:
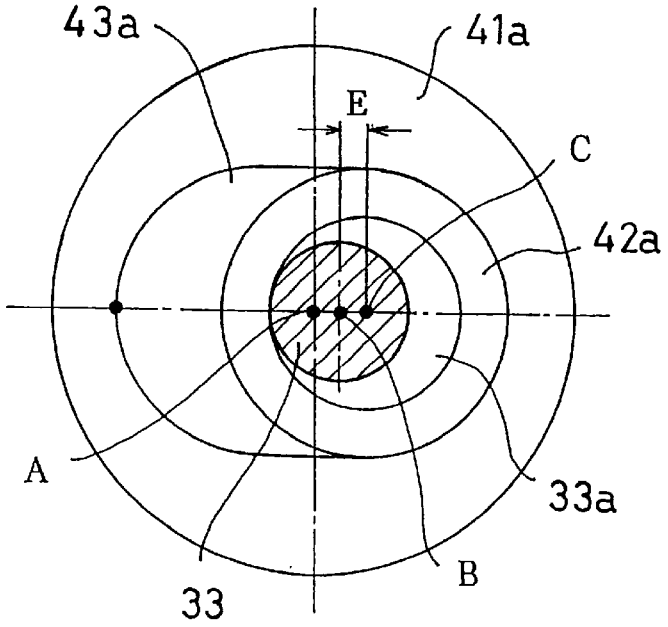
FIG. 2 is a sectional view taken along a line II—II in FIG. 1.
Figure 3:
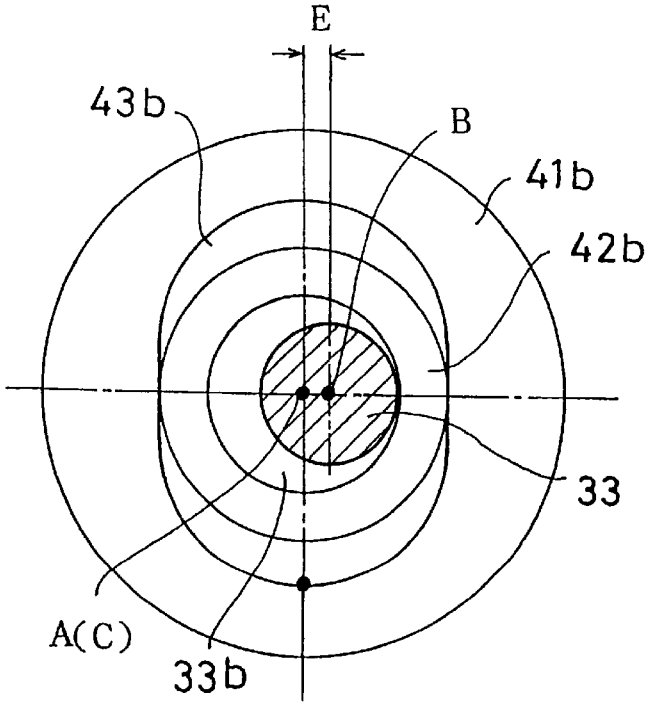
FIG. 3 is a sectional view taken along a line III—III in FIG. 1.
Figure 4:
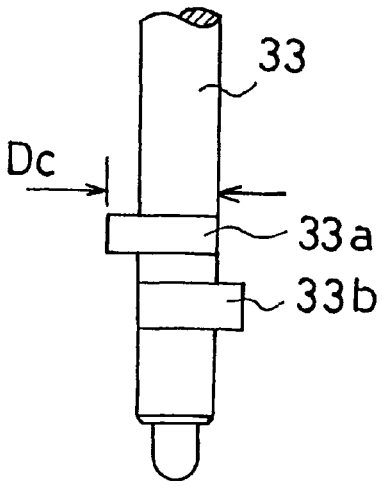
FIG. 4 is a side view of an essential portion of a shaft 33.

FIG. 1 is a vertical sectional view of a hermetic compressor according to an embodiment of the present invention; FIG. 2 is a sectional view taken along a line II—II in FIG. 1; FIG. 3 is a sectional view taken along a line III—III in FIG. 1; and FIG. 4 is a view for explaining the movement in a compressing mechanism in the embodiment.

Referring to FIG. 1, a hermetic compressor according to the embodiment of the present invention includes a motor mechanism section 30 and a compressor mechanism section 40 within a shell 10 forming a closed container.

The shell 10 includes a discharge pipe 11 at an upper portion thereof, and two intake pipes 12*a* and 12*b* on a side of a lower portion thereof.

The motor mechanism section 30 is comprised of a stator 31 fixed to the shell 10, and a rotor 32 which is rotated. The rotation of the rotor 32 is transmitted to the compressor mechanism section 40 by a shaft 33.

The compressor mechanism section 40 comprises a first compressing mechanism 40*a* which is comprised of a first rotary cylinder 41*a* and a first piston 42*a,* and a second compressing mechanism 40*b* which is comprised of a second rotary cylinder 41*b* and a second piston 42*b*. The first rotary cylinder 41*a* has a groove 43*a,* and the second rotary cylinder 41*b* has a groove 43*b*. The first piston 42*a* is slidably provided in a groove 43*a,* and the second piston 42*b* is slidably provided in a groove 43*b*. Members forming the first compressing mechanism 40*a* and the second compressing mechanism 40*b* are of the same size and shape.

The first and second compressing mechanisms 40*a* and 40*b* are partitioned from each other by a partition plate 44. The partition plate 44 has a through-bore 45. The first rotary cylinder 41*a,* the second rotary cylinder 41*b* and the partition plate 44 are connected to one another and moved in the same manner. However, the first and second rotary cylinders 41*a* and 41*b* are connected to each other with the grooves 43*a* and 43*b* offset from each other through 90 degree, so that the phases in the compressing strokes are different from each other by 180 degree.

On the other hand, the first and second pistons 42*a* and 42*b* are fitted into a first crank 33*a* and a second crank 33*b*, respectively. The first and second cranks 33*a* and 33*b* are mounted, so that the eccentric directions are different from each other by 180 degree.

The first and second compressing mechanisms 40*a* and 40*b* are clamped from above and below by an upper bearing 50*a* and a lower bearing 50*b* and surrounded by a cylindrical casing 51.

The upper bearing 50*a* is provided with an intake port 51*a* and a discharge port 52*a* for the first compressing mechanism 40*a*, and the lower bearing 50*b* is provided with an intake port 51*b* and a discharge port 52*b* for the second compressing mechanism 40*b*. Valves 53*a* and 53*b* opened by a predetermined pressure and valve stoppers 54*a* and 54*b* for limiting the opening movement of the valves 53*a* and 53*b* are provided in the discharge port 52*a* and 52*b*, respectively. The intake port 51*a* communicates with the intake pipe 12*a,* and the intake port 51*b* communicates with the intake pipe 12*b*. The intake pipes 12*a* and 12*b* are connected to an accumulator 60.

The flow of a refrigerant in the hermetic compressor having the above-described arrangement will be described below in brief.

The gas refrigerant in the accumulator 60 is introduced through the intake pipes 12*a* and 12*b* into the shell 10 and drawn through the intake ports 51*a* and 51*b* into the first and second compressing mechanisms 40*a* and 40*b*. When the pressure of the refrigerant compressed in the first and second compressing mechanisms 40*a* and 40*b* reaches a predetermined value, the refrigerant pushes up the valves 53*a* and 53*b* and is then discharged through the discharge ports 52*a* and 52*b* into the shell 10. In this case, the discharge timings are not the same, because the phases of the first and second compressing mechanisms 40*a* and 40*b* are different from each other by 180 degree. The refrigerant discharged into the shell 10 is passed around the motor mechanism section 30 and discharged out of the shell 10 through the discharge pipe 11 provided at the upper portion of the shell 10.

The relationship between the shaft 33, the pistons 42*a* and 42*b* and the rotary cylinders 41*a* and 42*b* in the first and second compressing mechanisms 40*a* and 40*b* will be described below with reference to FIGS. 2 and 3.

The shaft 33 which transmits the rotation of the motor mechanism section 30 is rotated about a point B. The rotational centers C of the cranks 33*a* and 33*b* provided on the shaft 33 are provided eccentrically by a distance from the center B of the shaft 33. The rotational centers C of the cranks 33*a* and 33*b* correspond to the rotational centers of the pistons 42*a* and 42*b*. On the other hand, the rotational centers of the rotary cylinders 41*a* and 41*b* are points spaced apart at a distance E from the center B of the shaft 33. Therefore, the groove 43*a* defines the maximum and minimum spaces as shown in FIG. 2, when the orbital center C of the crank 33*a* or the piston 42*a* is spaced apart at the largest distance from the rotational center A of the rotary cylinder 41*a*. The second compressing mechanism 40*b* has a phase difference of 180 degree from the first compressing mechanism 40*a* and hence, when the first compressing mechanism 40*a* is in a state shown in FIG. 2, the orbital center C of the second compressing mechanism 40*b* overlaps with the rotational center A of the rotary cylinder 41*b*, as shown in FIG. 3. Therefore, the space of the groove 43*b* is divided into two equal spaces, as shown in FIG. 3.

Figure 5:
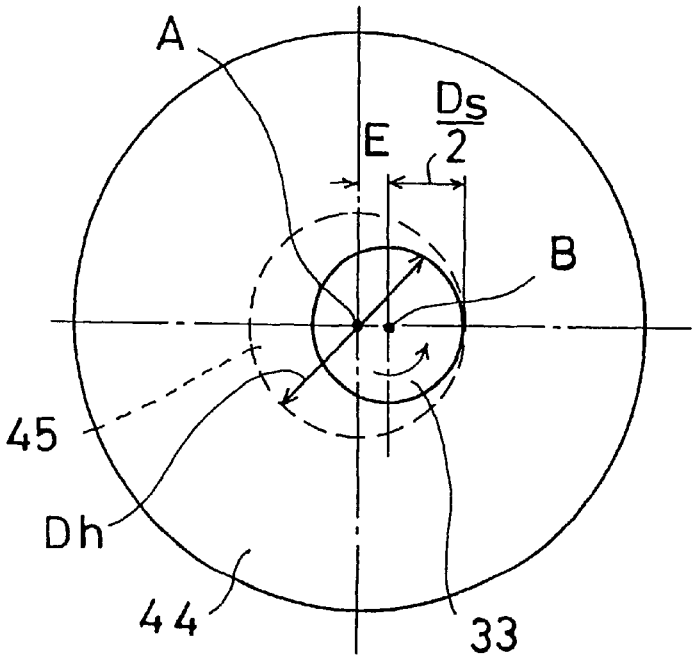
FIG. 5 is an arrangement illustration for explaining the positional relationship between a through-bore 45 and the shaft 33.
Figure 6:
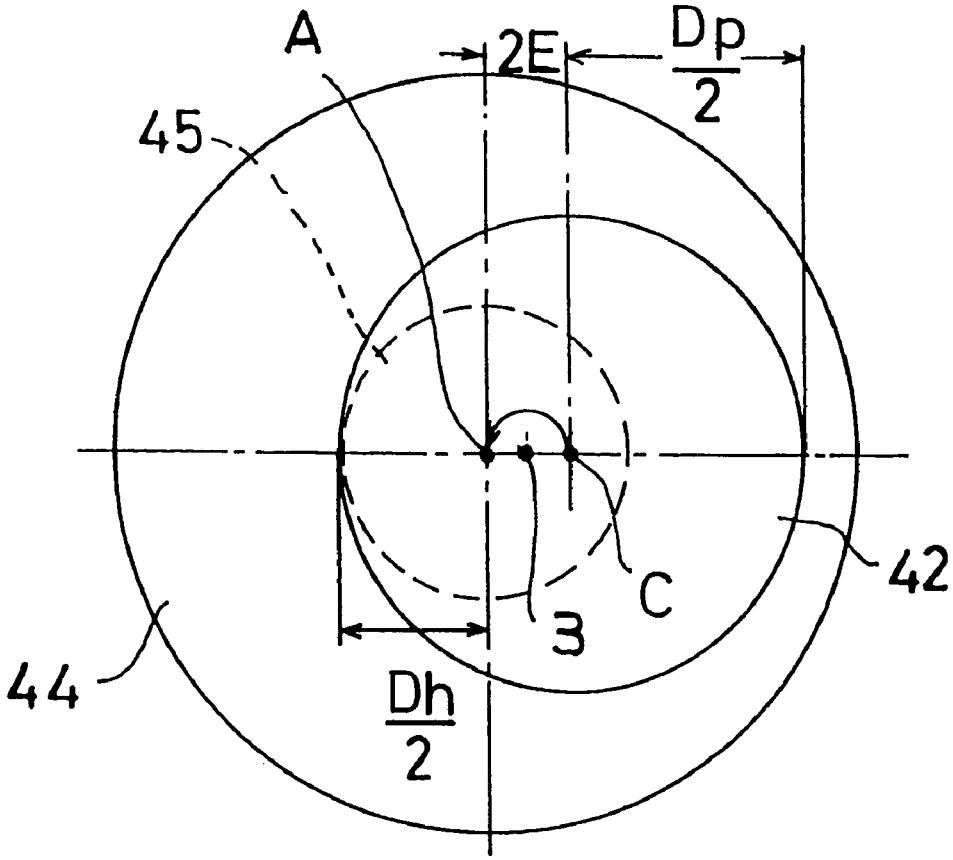
FIG. 6 is an arrangement illustration for explaining the positional relationship between through-bore 45 and a piston 42.

The size of the through-bore 45 provided in the partition plate 44 will be described below with reference to FIGS. 4 to 6. FIG. 4 is a side view of an essential portion of the shaft 33; FIG. 5 is a view for explaining the positional relationship between the through-bore 45 and the shaft 33; and FIG. 6 is a view for explaining the positional relationship between the through-bore 45 and the piston 42.

First, the relationship between the shaft 33 and the through-bore 45 will be described below with reference to FIG. 4.

When the compressor mechanism section is assembled, the through-bore 45 must be provided in the cranks 33*a* and 33*b* having the maximum diameter of the shaft 33. Therefore, the through-bore 45 must have a diameter equal to or larger than the diameter Dc of the cranks 33*a* and 33*b*.

The relationship between the shaft 33 and the through-bore 45 during compression of the compressor will be described below with reference to FIG. 5.

As described above, the shaft 33 is rotated about the position B spaced apart at the distance E from the rotational center A of the rotary cylinder. Therefore, the through-bore 45 must open in a range of movement of the shaft 33.

Namely, the diameter Dh of the through-bore 45 must satisfy the following relationship:

$$Dh/2 \geqq E+Ds/2$$

Therefore, a relation, $Dh \geqq 2E+Ds$ is required.

The relationship between the piston 42 and the through-bore 45 during compression of the compressor will be described below with reference to FIG. 6.

As described above, the piston 42 is rotated about the center B of the shaft 33. Therefore, in order to ensure that the through-bore 45 is always occluded by the piston 42, the diameter Dh of the through-bore 45 must satisfy the following relation:

$$Dh/2 \leqq 2E+Dp/2$$

Figure 7:
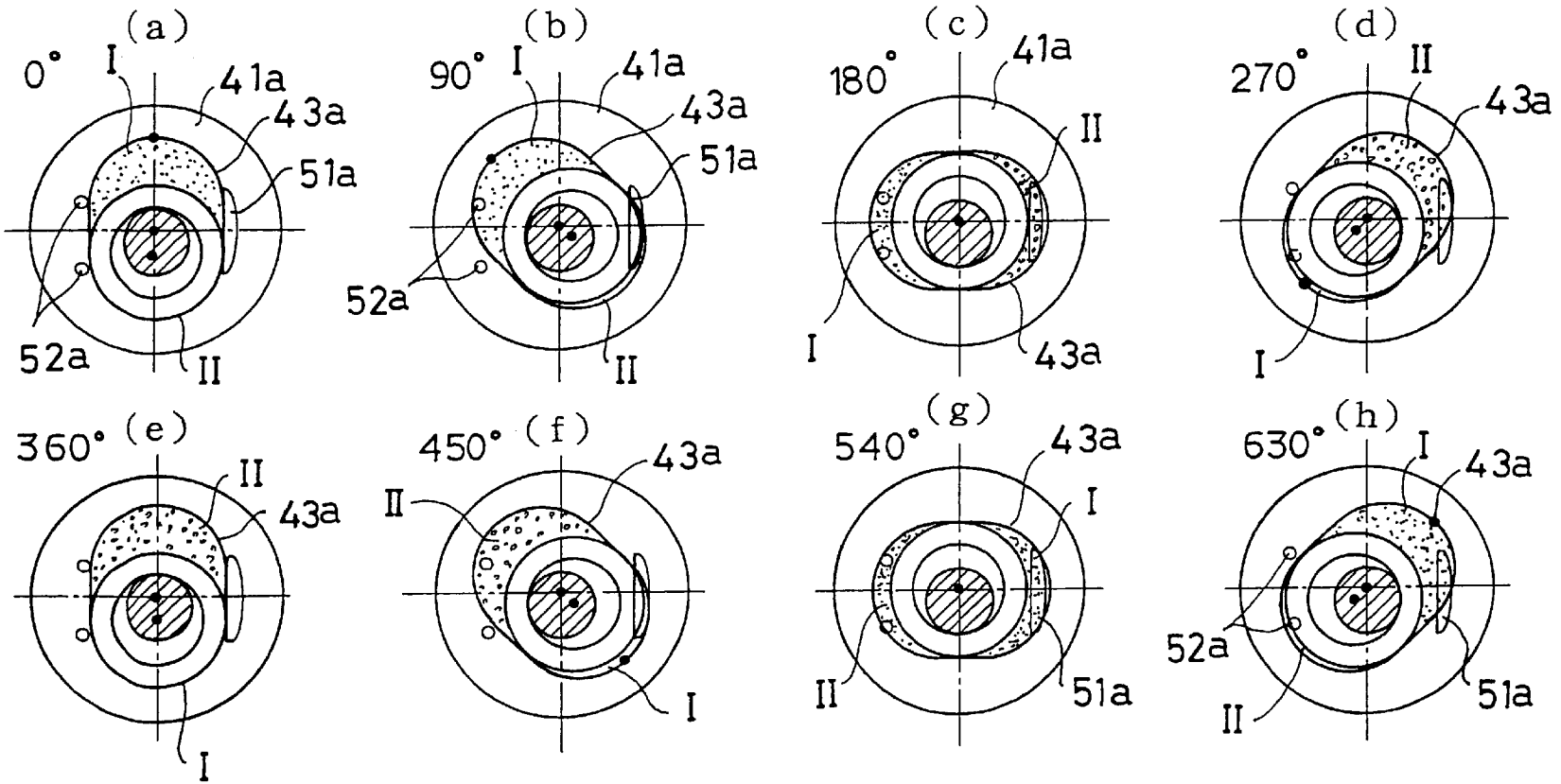
Figure 8:
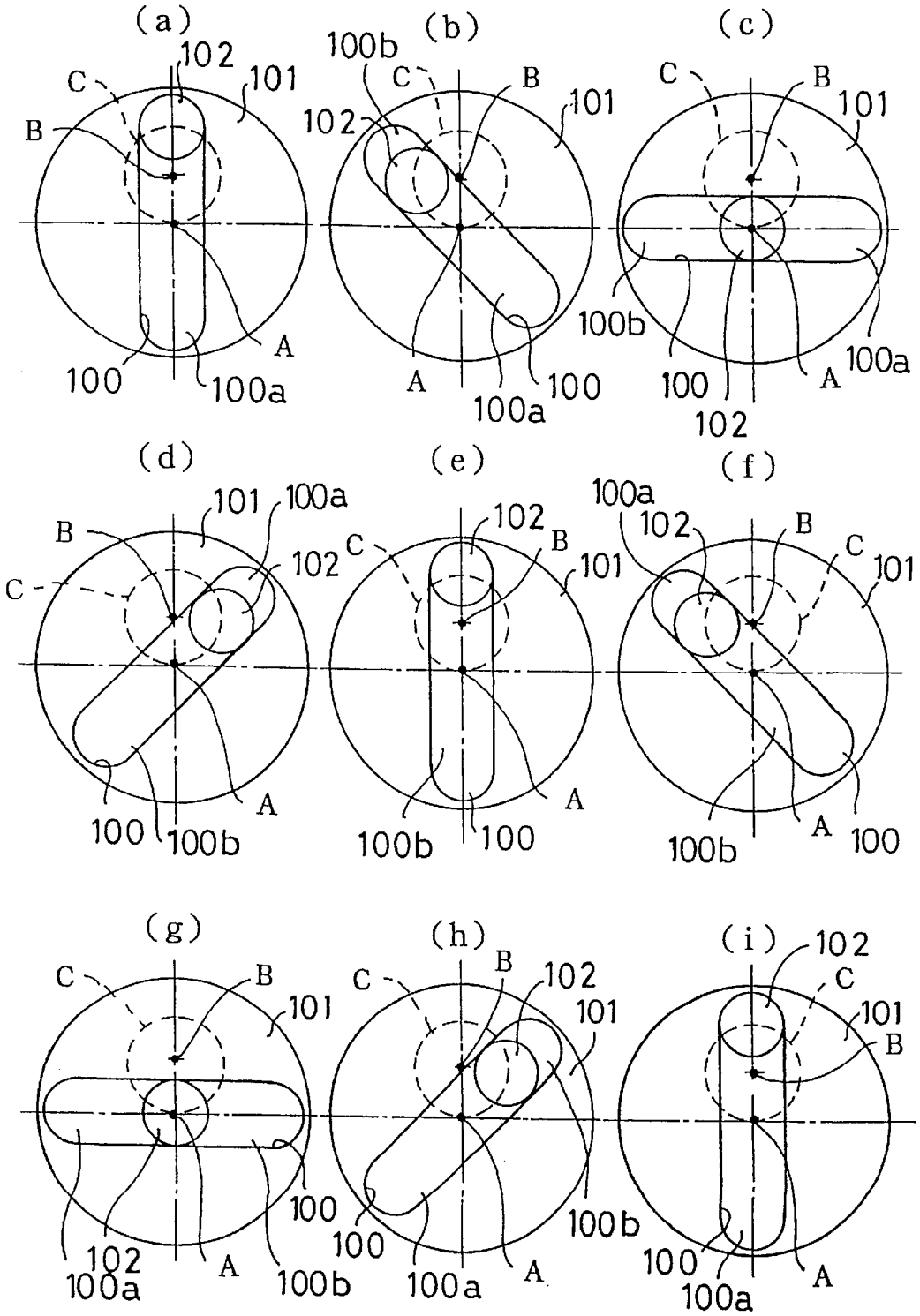

The strokes of suction and compression of the refrigerant gas will be described below with reference to FIG. 7. Here, the first compressing mechanism 40*a* will be described, but the second compressing mechanism 40*b* performs the same stroke as the compressing mechanism portion 40*a*, except that its phase in FIG. 7 is only different from that of the first compressing mechanism 40*a* by 180 degree.

FIGS. 7*a* to 7*h* show states in which the shaft 33 has been rotated through every 90 degree.

First, when the shaft 33 is rotated through 0 (zero) degree, as shown in FIG. 7*a*, the groove 43*a* is in a state in which the space I in the groove 43*a* is of the maximum volume, and the space II in the groove 43*a* is of the minimum volume.

The volume of the space I is gradually decreased from the state in FIG. 7*c* in which the shaft 33 has been rotated through 180 degree to the state in FIG. 7*d* in which the shaft 33 has been rotated through 270 degree, thereby discharging the compressed refrigerant from the discharge port 52*a*. The compressing stroke in the space I is finished in a state shown in FIG. 7*e* in which the shaft 33 has been rotated through 360 degree.

On the other hand, the volume of the space II is gradually increased from the state in FIG. 7*c* in which the shaft 33 has been rotated through 180 degree to the state in FIG. 7*d* in which the shaft 33 has been rotated through 270 degree, thereby sucking the compressed refrigerant from the intake port 51*a*. The suction stroke in the space II is finished in a state shown in FIG. 7*e* in which the shaft 33 has been rotated through 360 degree.

In the states shown in FIGS. 7*e* to 7*h*, the suction stroke is carried out in the space I, and the compressing stroke is carried out in the space II. When the shaft 33 is further rotated through 90 degree from the state shown in FIG. 7*h*, the state shown in FIG. 7*a* is obtained.

In the spaces I and II defined in the groove 43*a*, the compressing and suction strokes are carried out, respectively, while the shaft 33 is rotated through 720 degree.

According to the above-described embodiment, even if the piston is located at the center of the rotary cylinder in one of the compressing mechanisms, it is possible to avoid the case where the driving force from the piston does not act as a rotational force for the rotary cylinder, because the other compressing mechanism has a rotational force. In addition, by the fact that the difference between the phases of the two compressing mechanism is 180 degree, the pistons can be disposed symmetrically with each other, and hence, the compressor can be easily produced. By providing the intake ports and the discharge ports in the upper and lower bearings, the freedom degree of setting of the positions of the intake ports and the discharge ports is increased. Therefore, it is possible to regulate the compression ratio and to prevent the over-compression by virtue of the positions of the intake ports and the discharge ports. Further, by the fact that the phases of the first and second compressing mechanisms are different from each other, and the intake port in the upper bearing and the intake port in the lower bearing are provided on the same axis, the intake pipes can be mounted on the same side, and a piping cannot be drawn around for connection of the intake pipes to the accumulator or the like.

The difference in phase between the two compressing mechanisms is of 180 degree in this embodiment, but is not limited thereto and may be of 90 or 270 degree or another value.

The present embodiment has been described as being provided with the two compressing mechanisms, but three or more compressing mechanisms may be provided.

INDUSTRIAL APPLICABILITY

As can be seen from the above description, according to the present invention, the following principle of the compressing mechanism can be utilized in the hermetic compressor: the compressing stroke is carried out by rotation of the piston on the locus having the radius E about the point spaced apart at the distance E from the center of the rotary cylinder.

The compressing mechanism performs the compression and the suction by only the rotating movements of the rotary cylinder and the piston, and does not require a member which is moved in a diametrical direction. Therefore, it is possible to realize the hermetic compressor wherein even if the compressing mechanism is fixed within the shell, only an extremely small vibration occurs.

In addition, according to the present -invention, the two compressing mechanisms can be constructed by inserting the shaft from one side of the partition plate by ensuring that the diameter Dh of the communication bore is set in the range of $Dh \geqq Dc$ and $Dh \leqq Dp-4E$. Therefore, it is possible to provide the arrangement of the compressing mechanisms which can be industrially produced.

Further, the communication bore is in the state in which it is always occluded by the piston, by ensuring that the diameter Dh of the communication bore is set in the range of $Dh \leqq Dp-4E$. Therefore, it is possible to provide the hermetic compressor having a higher compressing efficiency, wherein even if the compressing strokes in the two compressing spaces are different from each other, the compressed gas in one of the compressing spaces is prevented from being leaked into the other compressing space.

What is claimed is:

1. A close-type compressor comprising a plurality of compressing mechanisms each of which includes a rotary cylinder having a groove, and a piston, so that a compressing stroke is carried out by rotation of the piston on a locus of a radius E about a location spaced apart at a distance E from the center of the rotary cylinder; and a motor for driving said compressing mechanisms, said compressing mechanisms and said motor being fixed within a shell, wherein all the rotary cylinders are connected together, and all the pistons are driven by a common shaft; and the phase in the compression stroke in at least one of the compressing mechanisms is different from those in the other compressing mechanisms.

2. A hermetic compressor comprising two compressing mechanisms each of which includes a rotary cylinder having a groove, and a piston slidable in said groove, so that a compressing stroke is carried out by rotation of the piston on a locus of a radius E about a location spaced apart at a distance E from the center of the rotary cylinder; and a motor for driving said compressing mechanisms, said compressing mechanisms and said motor being fixed within a shell, wherein the rotary cylinders are connected to each other, and the pistons are driven by a common shaft; and the phases in the compression strokes in the first and second compressing mechanisms are different from each other.

3. A hermetic compressor according to claim 1 or 2, wherein a difference between said phases is 180°.

4. A hermetic compressor according to claim 1 or 2, wherein said compressing mechanisms are disposed within a lower portion of said shell, and a lubricating oil is accumulated in the lower portion of said shell.

5. A hermetic compressor according to claim 2, wherein said first and second compressing mechanisms are provided between an upper bearing and a lower bearing; an intake port and a discharge port for said first compressing mechanism are provided in said upper bearing, and an intake port and a discharge port for said second compressing mechanism are provided in said lower bearing.

6. A hermetic compressor according to claim 5, wherein the phases of said first and second compressing mechanisms are different by 180 degree from each other, and said intake port in said upper bearing and said intake port in said lower bearing are provided on the same axis.

7. A hermetic compressor according to claim 5, wherein each of said intake ports is provided at a location in which it is not in communication with two spaces defined in said groove by said piston, when said two spaces are in a relationship of maximum and minimum to each other.

8. A hermetic compressor according to claim 5, wherein each of said discharge ports is provided at a location in which it is not in communication with two spaces defined in said groove by said piston, when said two spaces are in a relationship of maximum and minimum to each other.

9. A hermetic compressor comprising two compressing mechanisms each including a rotary cylinder having a groove, and a piston slidable in said groove, so that a compression stroke is carried out by rotation of said piston on a locus of a radius E about a position spaced apart at a distance E from the center of said rotary cylinder, the rotary cylinders of said compressing mechanisms being connected to each other with a partition plate interposed therebetween, said partition plate being provided with a communication bore for passage of a shaft, said shaft being provided with a crank portion enabling the pistons to be mounted; and a motor mechanism section for driving said pistons of said compressing mechanisms by the common shaft, wherein the following expressions are established:

$$Dh \geqq Dc$$

$$Dh \geqq Ds+2E$$

wherein Dh represents a diameter of said communication bore; Ds represents a diameter of said shaft; and Dc represents a diameter of said crank portion.

10. A hermetic compressor according to claim 9, wherein the following expression is established:

$$Dh \leqq Dp-4E$$

wherein Dp represents a diameter of said piston.

* * * * *